US012582283B2

(12) United States Patent
Zheng

(10) Patent No.: US 12,582,283 B2
(45) Date of Patent: Mar. 24, 2026

(54) FULLY AUTOMATIC DISHWASHER AND AUTOMATIC CLEANING METHOD

(71) Applicant: Nanjing Lepus intelligent technology Co., Ltd., Wuxi (CN)

(72) Inventor: Wei Zheng, Wuxi (CN)

(73) Assignee: Nanjing Lepus intelligent technology Co., Ltd., Nanjing (CN)

( * ) Notice: Subject to any disclaimer, the term of this patent is extended or adjusted under 35 U.S.C. 154(b) by 36 days.

(21) Appl. No.: 18/822,405

(22) Filed: Sep. 2, 2024

(65) Prior Publication Data

US 2024/0415363 A1 Dec. 19, 2024

(30) Foreign Application Priority Data

Sep. 20, 2023 (CN) ..... 202311219312.7

(51) Int. Cl.
*A47L 15/00* (2006.01)
*A47L 15/42* (2006.01)

(52) U.S. Cl.
CPC ..... *A47L 15/0089* (2013.01); *A47L 15/0007* (2013.01); *A47L 15/4217* (2013.01); *A47L 15/4246* (2013.01); *A47L 15/4278* (2013.01); *A47L 2401/24* (2013.01); *A47L 2401/34* (2013.01); *A47L 2501/01* (2013.01); *A47L 2501/28* (2013.01); *A47L 2601/02* (2013.01)

(58) Field of Classification Search
None
See application file for complete search history.

(56) References Cited

U.S. PATENT DOCUMENTS 8,636,851 B2 1/2014 Rosenbauer
11,399,693 B2 * 8/2022 Aleali ..... A47L 15/4285
11,464,390 B2 10/2022 Haegermarck

FOREIGN PATENT DOCUMENTS

CN 117158857 A 12/2023
CN 221469793 U 8/2024

* cited by examiner

*Primary Examiner* — Rita P Adhlakha

(57) ABSTRACT

The present disclosure discloses a sequential dishwasher, and relates to the technical field of sequential dishwashers and automatic cleaning methods. The sequential dishwasher includes a casing to the bottom of which a drainage pipe is connected, a dish cleaning mechanism, arranged in the casing; a rotary drive mechanism, arranged below the dish cleaning mechanism; a liquid supply mechanism, arranged in the casing and used for providing a detergent or tap water for cleaning of two sides of a dish in a spraying manner; and a control system, configured to control and connect the dish cleaning mechanism, the rotary drive mechanism, and the liquid supply mechanism for a clamping drive, a rotary drive, and a liquid supply cleaning drive during dish cleaning. The present disclosure further provides an automatic cleaning method for dishes. The present disclosure may effectively save detergent consumption and water consumption of cleaning while realizing rapid cleaning of the single dish, and when facing cleaning of a small number of dishes, may complete the automatic cleaning of the dishes more efficiently with more energy saved.

9 Claims, 12 Drawing Sheets

FULLY AUTOMATIC DISHWASHER AND AUTOMATIC CLEANING METHOD

TECHNICAL FIELD

The present disclosure belongs to the technical field of dishwashers, and specifically relates to a sequential dishwasher and an automatic cleaning method.

BACKGROUND

An existing dishwasher adopts a spray mode to repeatedly clean tableware. In a cleaning process, a chemical detergent needs to be placed in the dishwasher and is heated to improve a cleaning effect of the tableware.

The existing dishwasher has the following shortcomings. 1, Energy consumption is large. To complete tableware cleaning once, a large amount of electrical energy needs to be consumed to heat the detergent to make it reach a best temperature. 2, Cleaning time is very long. It takes 1 to 2 hours to complete cleaning once. 3, The tableware with heavy stains further needs to be rinsed by hand once to be cleaned. In most households, particularly those with a family of three, the number of dishes generated during a meal is small. It is a waste to use the traditional dishwasher when the amount of tableware is very small, so we design and propose a sequential dishwasher and an automatic cleaning method for cleaning a small amount of tableware.

SUMMARY

An object of the present invention is to solve the disadvantages of the prior art, such as high cost of cleaning agent and electricity, long dishwashing time, and unstable cleaning effect caused by cleaning a small amount of tableware, and provide a sequential dishwasher and an automatic cleaning method. The sequential dishwasher and the automatic cleaning method may effectively save detergent consumption and water consumption of cleaning while realizing rapid cleaning of a single dish, and when facing cleaning of a small number of dishes, may complete the automatic cleaning of the dishes more efficiently with more energy saved.

In order to implement the above object, the present disclosure adopts the following technical solutions.

A sequential dishwasher is designed, including a casing, wherein a bottom of the casing is connected with a drainage pipe, a dish cleaning mechanism, arranged in the casing and used for clamping and cleaning a single dish; a rotary drive mechanism, arranged below the dish cleaning mechanism and used for driving the dish to rotate in forward and reverse directions alternately; a liquid supply mechanism, arranged in the casing and used for providing a detergent or tap water for cleaning of two sides of the dish in a spraying manner; and a control system, configured to control and connect the dish cleaning mechanism, the rotary drive mechanism, and the liquid supply mechanism for a clamping drive, a rotary drive, and a liquid supply cleaning drive during dish cleaning.

Further, the dish cleaning mechanism includes a fixed frame, a cleaning arm, a first cleaning sponge, and a second cleaning sponge. The first cleaning sponge and the second cleaning sponge are respectively correspondingly arranged on the fixed frame and the cleaning arm. The first cleaning sponge is fixed on the fixed frame in a vertical state. The second cleaning sponge is fixed on the cleaning arm in an L-shaped state. A linear drive mechanism for driving the second cleaning sponge to move in parallel is arranged below the cleaning arm.

Further, the linear drive mechanism includes a first drive motor, a first screw rod, guide shafts, and a sliding block. Two sides of the sliding block are slidably connected on the guide shafts. One end of the cleaning arm away from the second cleaning sponge is fixed on the sliding block. The first screw rod for driving the movement of the sliding block is arranged between the two guide shafts. One end of the first screw rod is provided with the first drive motor for driving the first screw rod to rotate. One side of the sliding block corresponding to the second cleaning sponge is provided with a dish limiting plate.

Further, the rotary drive mechanism includes two transmission rollers arranged in parallel. One of the transmission rollers is connected with an output end of a second drive motor through a coupling. The other ends of the two transmission rollers are provided with synchronous gears. A transmission belt is connected between the two synchronous gears.

Further, the sequential dishwasher further includes a lifting mechanism for lifting and lowering the dish cleaning mechanism. The lifting mechanism is arranged on two sides of the dish cleaning mechanism and includes a support wall. The support wall is fixed on two sides of the casing. A sliding rail is vertically fixed on the support wall. A movable platform is slidably connected to the sliding rail. A second screw rod for driving the moving platform to move up and down is fixed on the support wall. One end of the second screw rod is provided with a third drive motor for driving the second screw rod to rotate.

Further, the liquid supply mechanism includes a liquid supply pump. A liquid inlet pipe of the liquid supply pump is connected with a washing liquid tank and a tap water pipe respectively. A liquid outlet pipe of the liquid supply pump is connected with a plurality of nozzles. After the dish cleaning mechanism clamps the dish, the nozzles are distributed on the two sides of the dish.

Further, the control system includes a control unit, a material sensor and a first position sensor which are connected with the control unit. The material sensor is fixedly arranged in the first cleaning sponge, is used for sensing whether the dish is put into the dishwasher, and starts automatic operation after detecting that the dish is put into the dishwasher. Two sensing terminals of the first position sensor are respectively arranged between the cleaning arm and the fixed frame, and are used for sensing a displacement magnitude of a movement of the cleaning arm.

Further, the control system further includes a plurality of second position sensors connected with the control unit. Two sensing terminals of each of the plurality of second position sensors are respectively arranged between the movable platform and the support wall, and are used for sensing the lifting height of the lifting mechanism.

Further, the control system further includes two solenoid valves connected with the control unit. The two solenoid valves are respectively arranged on the liquid inlet pipe connected with the washing liquid tank and the tap water pipe.

In order to solve the above technical problems, the present disclosure further provides an automatic cleaning method for dishes, used for the sequential dishwasher, specifically including the following steps:

step 1, starting the sequential dishwasher, putting a bowl or plate to be cleaned on a dish cleaning mechanism, and clamping the bowl or the plate by the dish cleaning mechanism;

step 2, starting a rotary drive mechanism to drive the bowl or the plate to perform a forward or reverse unidirectional rotation;

step 3, starting a liquid supply mechanism to spray a quantitative detergent to two sides of the bowl or the plate, after completing cleaning time of the detergent for the bowl or the plate, continuously spraying tap water to the two sides of the bowl or the plate until cleaning time of the tap water for the bowl or the plate is completed, and turning off the liquid supply mechanism; and step 4, after completing step 3, turning off the rotary drive mechanism, resetting the dish cleaning mechanism, and completing cleaning of the bowl or the plate.

Compared with the prior art, adopting the sequential dishwasher and the automatic cleaning method proposed by the present disclosure has the following beneficial effects. When a small number of dishes are cleaned, the single dish is put into the dishwasher, clamped by the dish cleaning mechanism, and is driven to rotate by the rotary drive mechanism, and the liquid supply mechanism performs precise liquid supply cleaning on the dish. Detergent consumption and water consumption of cleaning may be effectively saved while realizing rapid cleaning of the single dish. There is no need to heat a water body, which saves more energy. There is no need to manually clean tableware with heavy stains, which is more convenient and worry-free to use. When the small number of dishes are cleaned, the automatic cleaning of the dishes may be completed more efficiently.

BRIEF DESCRIPTION OF DRAWINGS

Accompanying drawings are used for providing further understanding of the present disclosure, form a part of the specification, are used together with embodiments of the present disclosure for explaining the present disclosure, and do not constitute a limitation on the present disclosure. In the accompanying drawings.

Figure 1:
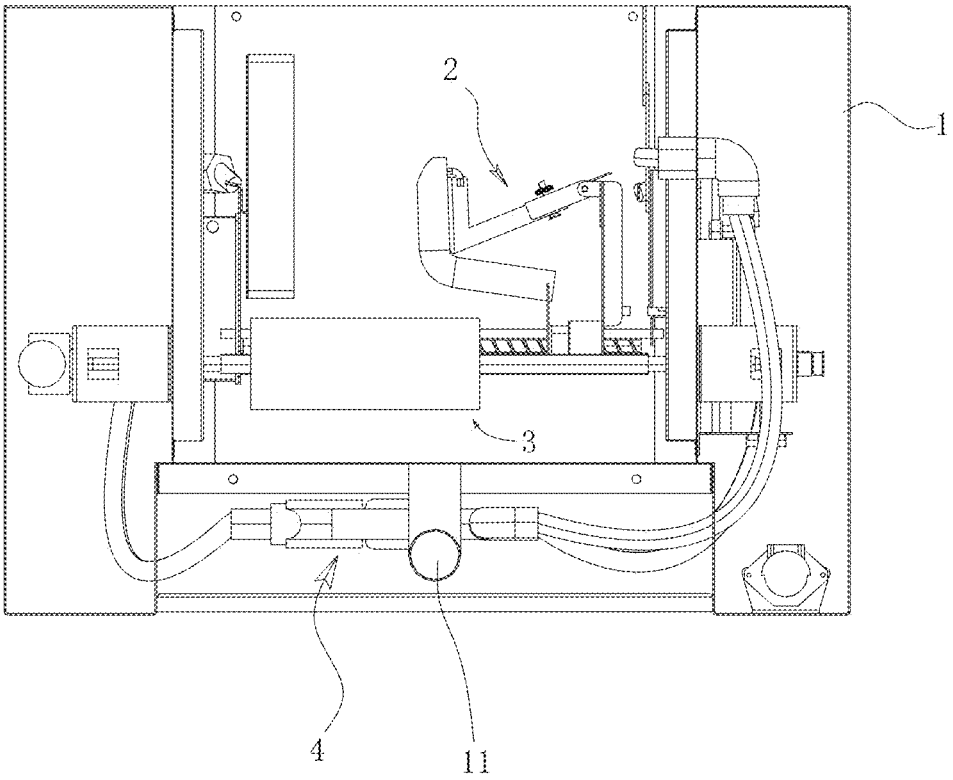
FIG. 1 is a schematic diagram showing an internal structure of a sequential dishwasher according to an Embodiment 1 of the present disclosure.
Figure 2:
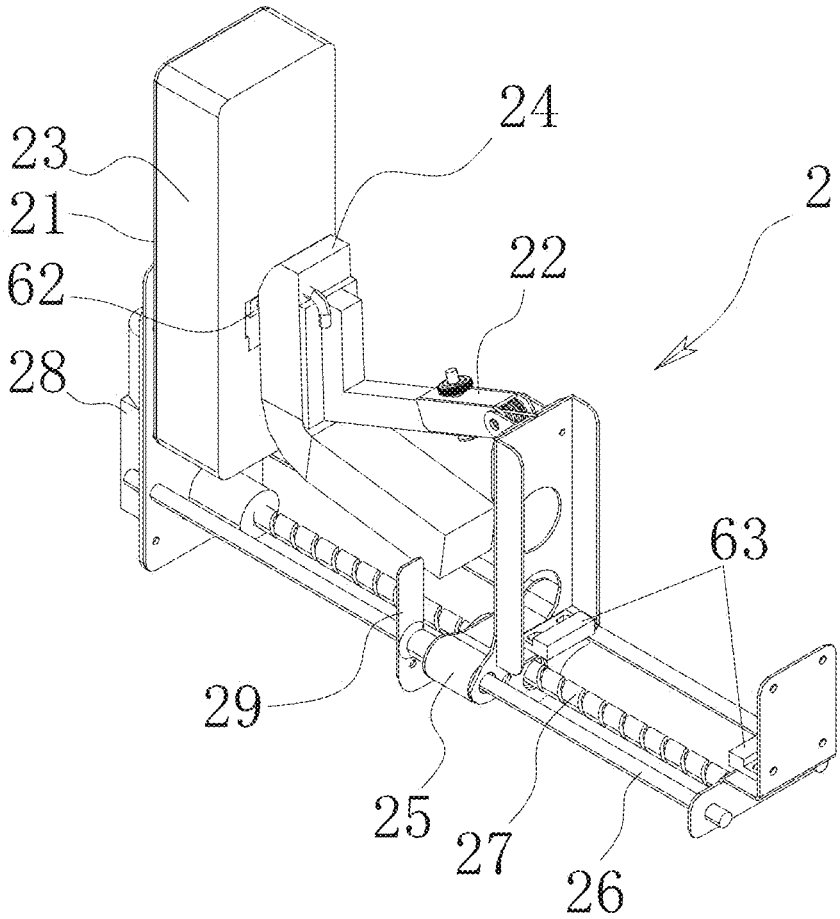
FIG. 2 is a schematic perspective view of a dish cleaning mechanism according to an Embodiment 1 of the present disclosure.
Figure 3:
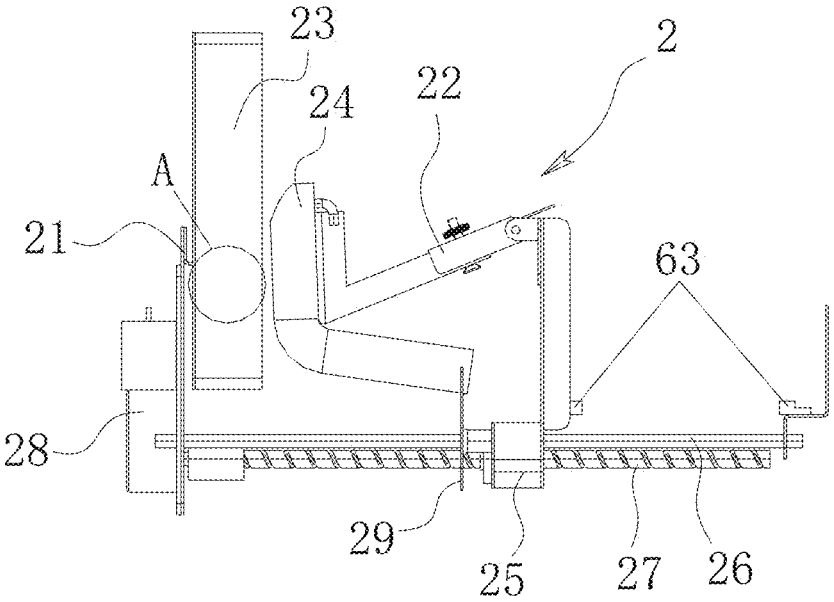
FIG. 3 is a schematic side view of a dish cleaning mechanism according to an Embodiment 1 of the present disclosure.
Figure 4:
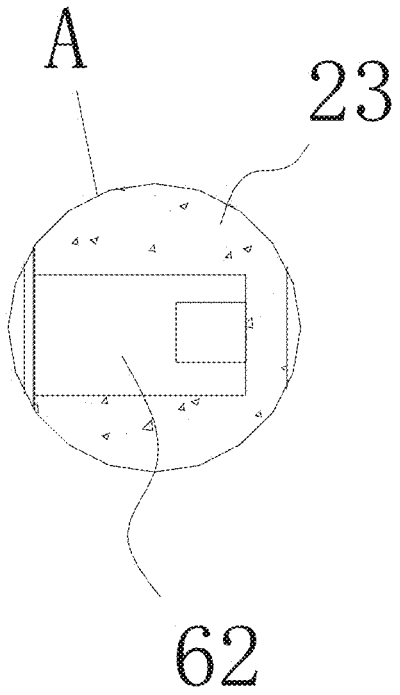
FIG. 4 is a schematic cross-sectional view taken at A in FIG. 3 according to an Embodiment 1 of the present disclosure.
Figure 5:
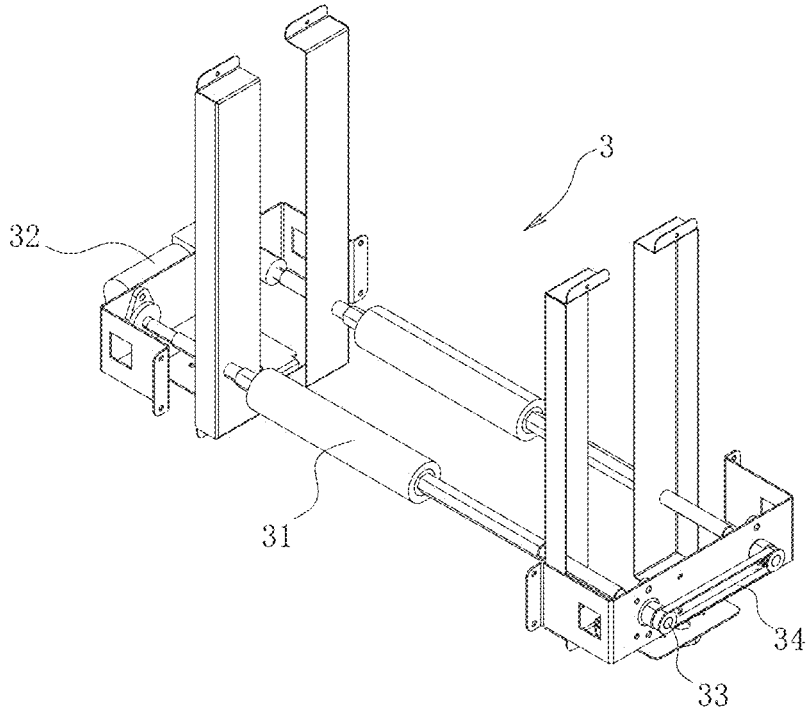
FIG. 5 is a schematic perspective view of a rotary drive mechanism according to an Embodiment 1 of the present disclosure.
Figure 6:
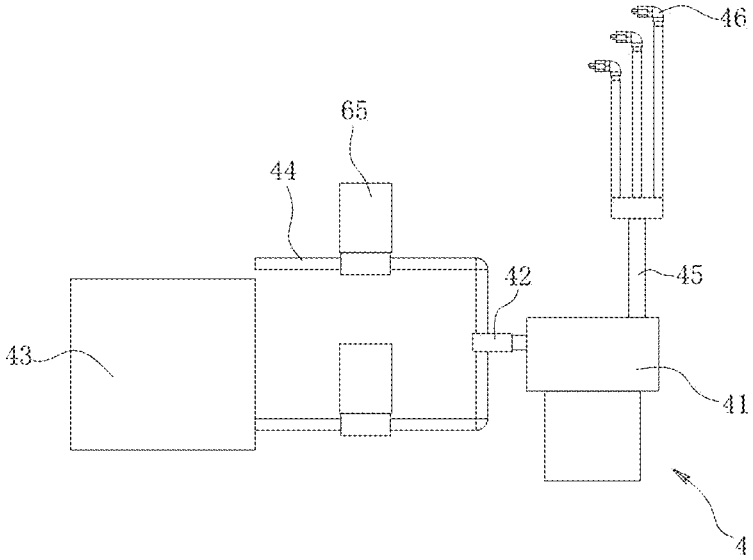
FIG. 6 is a schematic structural diagram showing a liquid supply mechanism according to an Embodiment 1 of the present disclosure.
Figure 7:
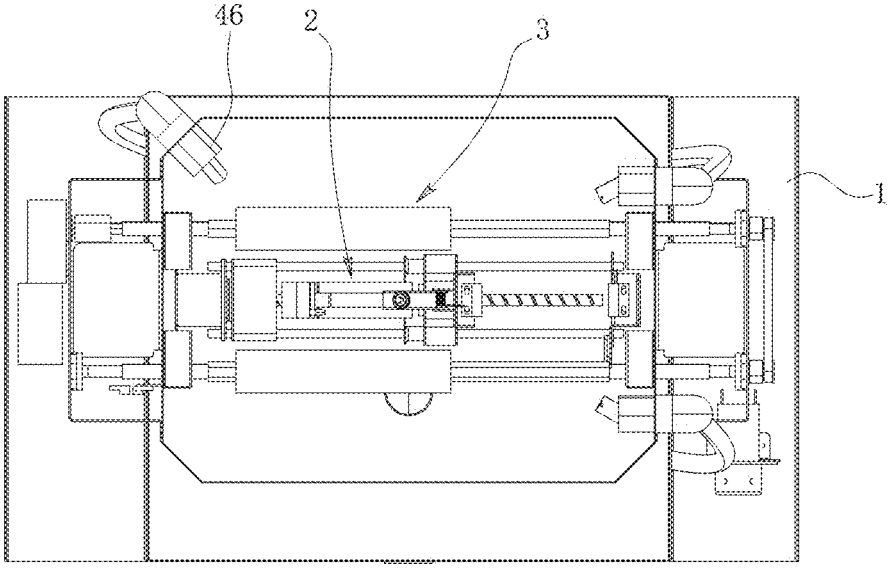
FIG. 7 is a schematic structural diagram showing a distribution of nozzles in a casing according to an Embodiment 1 of the present disclosure.
Figure 8:
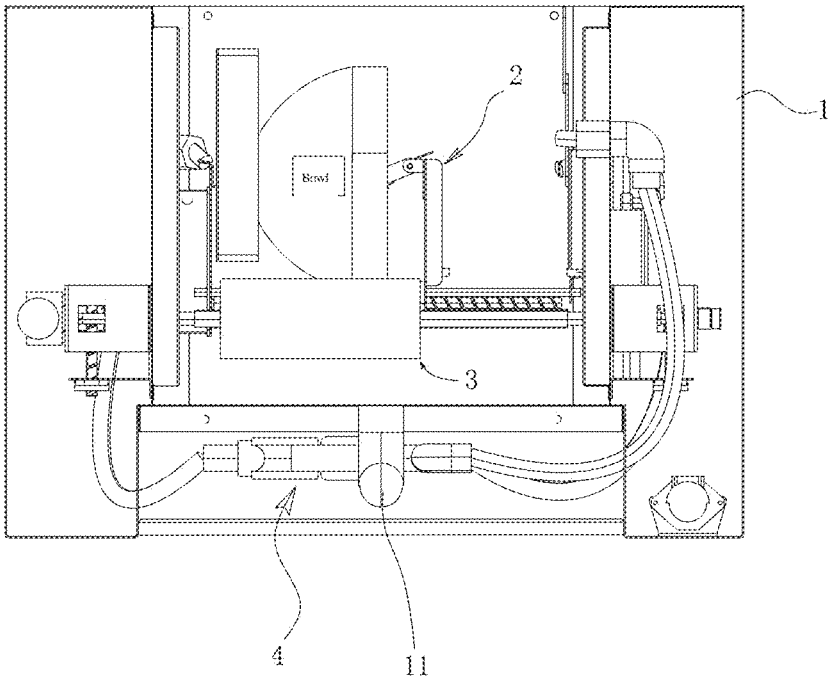
FIG. 8 is a schematic structural diagram showing cleaning a bowl in a sequential dishwasher according to an Embodiment 1 of the present disclosure.
Figure 9:
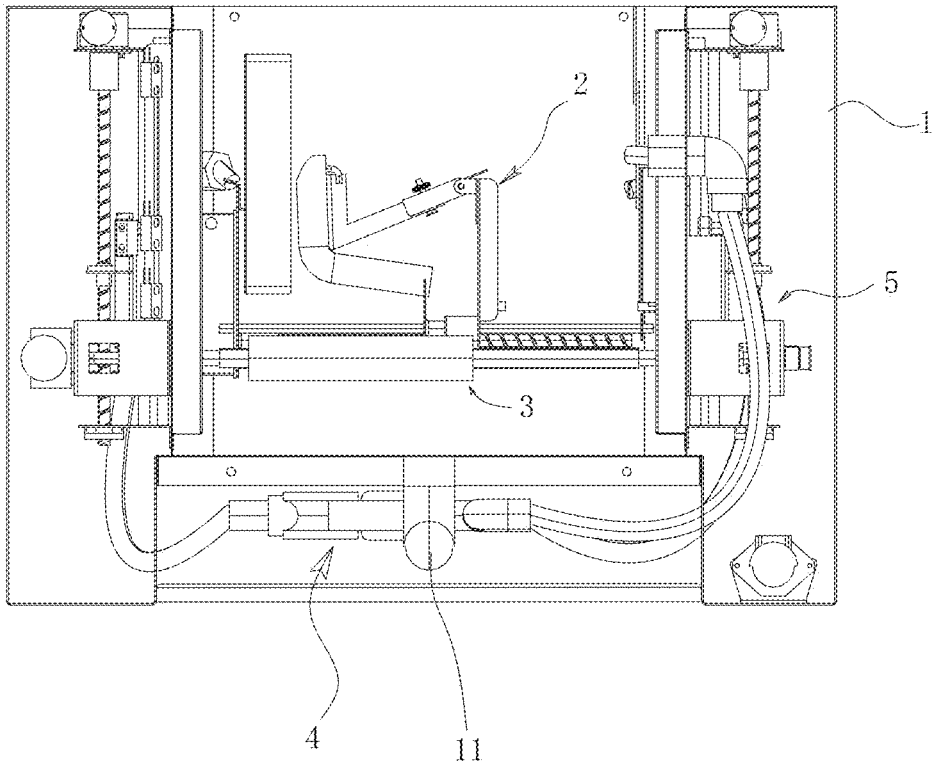
FIG. 9 is a schematic diagram showing an internal structure of a sequential dishwasher according to an Embodiment 2 of the present disclosure.
Figure 10:
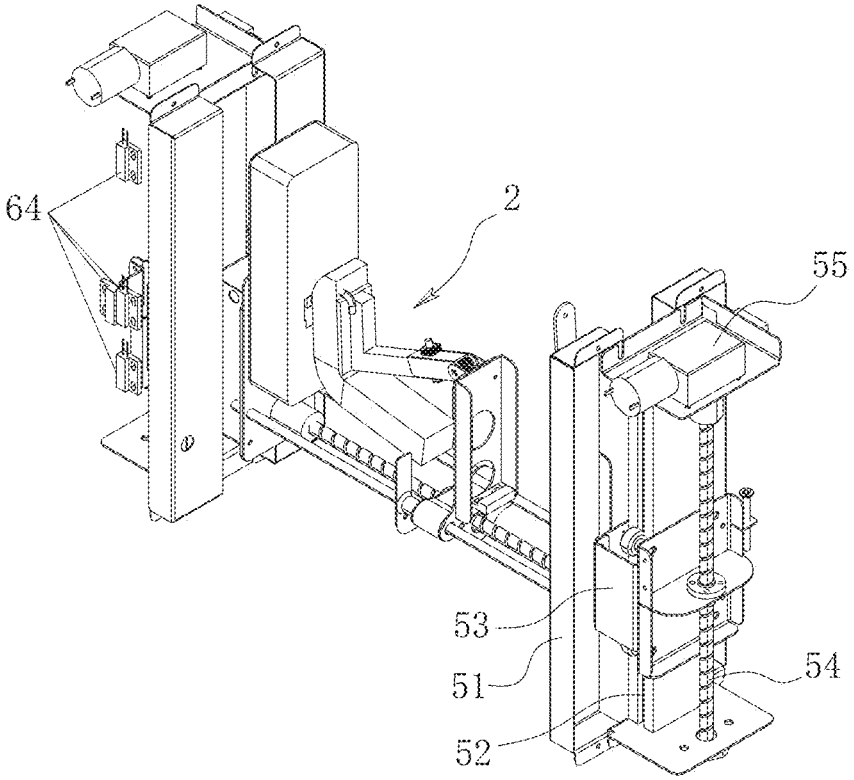
FIG. 10 is a schematic perspective view showing an assembly of a lifting mechanism and a dish cleaning mechanism according to an Embodiment 2 of the present disclosure.
Figure 11:
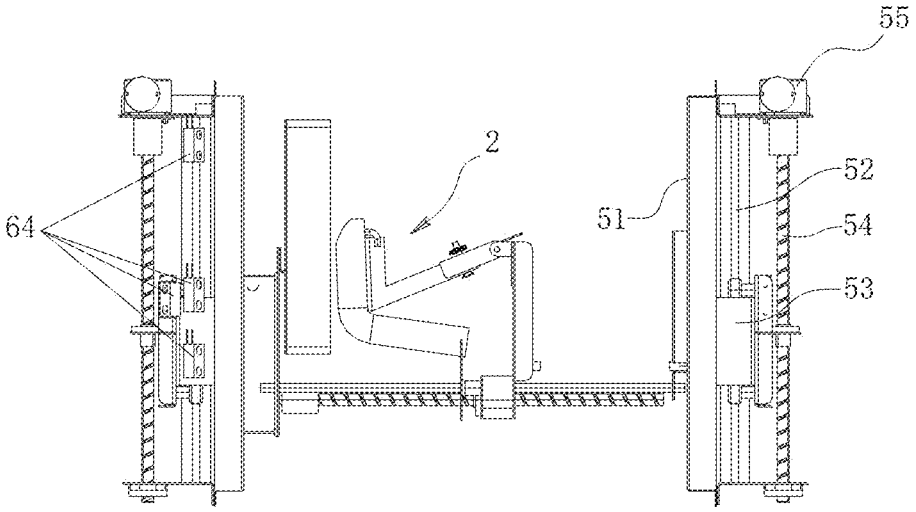
FIG. 11 is a schematic side view of assembly of a lifting mechanism and a dish cleaning mechanism according to an Embodiment 2 of the present disclosure.

Reference numerals in the figures are as: 1. casing; 11. drainage pipe; 2. dish cleaning mechanism; 21. fixed frame; 22. cleaning arm; 23. first cleaning sponge; 24. second cleaning sponge; 25. sliding block; 26. smooth shaft; 27. first screw rod; 28. first drive motor; 29. dish limiting plate; 3. rotary drive mechanism; 31. transmission roller; 32. second drive motor; 33. synchronous gear; 34. transmission belt; 4. liquid supply mechanism; 41. liquid supply pump; 42. liquid inlet pipe; 43. washing liquid tank; 44. tap water pipe; 45. liquid outlet pipe; 46. nozzle; 5. lifting mechanism; 51. support wall; 52. sliding rail; 53. movable platform; 54. second screw rod; 55. third drive motor; 6. control system; 61. control unit; 62. material sensor; 63. first position sensor; 64. second position sensor; and 65. solenoid valve.

DETAILED DESCRIPTION OF THE EMBODIMENTS

The embodiments of the present invention will now be described more fully hereinafter with reference to the accompanying drawings, in which: it is obvious that the described embodiments are only a part of the embodiments of the present invention, not all the embodiments, and all other embodiments obtained by a person of ordinary skill in the art without inventive effort are within the scope of the present invention based on the embodiments in the present invention.

In the description of the present disclosure, it needs to be noted that orientations or position relationships indicated by terms such as "above", "below", "inside", "outside", "top/bottom end" are orientations or position relationships shown based on the accompanying drawings, and are used only for facilitating the description of the present disclosure and for simplifying the description, rather than indicating or implying that a mentioned apparatus or element must have a particular orientation or must be constructed and operated in a particular orientation, thus cannot be understood as a limitation on the present disclosure. In addition, terms "first" and "second" are used only for the purpose of description, and cannot be understood as indicating or implying relative importance.

In the description of the present disclosure, it needs to be noted that, unless otherwise expressly specified or limited, terms "installed", "arranged", "sleeved/connected", "connected", etc., should be interpreted broadly, such as "connected", either fixedly or detachably, or integrally; may be a mechanical connection or an electrical connection; may be a direct connection or an indirect connection through an intermediate medium, and may be an internal communication between two elements. The specific meaning of the above terms in the present disclosure can be understood in detail by those skilled in the art.

Structural features of the present disclosure will now be described in detail with reference to the accompanying drawings.

Embodiment 1

Referring to FIG. 1-FIG. 8 and FIG. 12, a sequential dishwasher includes a casing 1. In order to reduce an occupied space of the casing 1, the casing 1 adopts a rectangular box structure, which can accommodate a bowl or a plate in a width direction, and completes a single time of cleaning of one bowl or plate. A bottom of the casing 1 is connected with a drainage pipe 11. The drainage pipe 11 is used for draining cleaning sewage in the casing 1, and the drainage pipe 11 is connected to a sewer through a pipe. The sequential dishwasher further includes:

a dish cleaning mechanism 2, arranged in the casing 1 and used for clamping and cleaning the single dish. The dish cleaning mechanism 2 includes a fixed frame 21, a cleaning arm 22, a first cleaning sponge 23, and a second cleaning sponge 24. The first cleaning sponge 23 and the second cleaning sponge 24 are respectively correspondingly arranged on the fixed frame 21 and the cleaning arm 22. The first cleaning sponge 23 is fixed on the fixed frame 21 in a vertical state. The second cleaning sponge 24 is fixed on the cleaning arm 22 in an L-shaped state. When the plate is cleaned, a food holding surface of the plate is put corresponding to one side of the first cleaning sponge 23, and when the bowl is cleaned, a food holding surface of the bowl is put corresponding to one side of the second cleaning sponge 24. A linear drive mechanism for driving the second cleaning sponge 24 to move in parallel is arranged below cleaning arm 22. The linear drive mechanism includes a first drive motor 28, a first screw rod 27, guide shafts 26, and a sliding block 25. Two sides of the sliding block 25 are slidably connected on the guide shafts 26. One end of the cleaning arm 22 away from the second cleaning sponge 24 is fixed on the sliding block 25. The first screw rod 27 for driving the sliding block 25 to move is arranged between the two guide shafts 26. One end of the first screw rod 27 is provided with the first drive motor 28 for driving the first screw rod to rotate. One side of the sliding block 25 corresponding to the second cleaning sponge 24 is provided with a dish limiting plate 29. Through the linear drive mechanism, the second cleaning sponge 24 may move in a direction away from the first cleaning sponge 23, so that a distance between the first cleaning sponge 23 and the second cleaning sponge 24 increases. After putting the bowl or the plate into the first cleaning sponge 23 and the second cleaning sponge 24, the second cleaning sponge 24 is moved in reverse, and under an effect of the dish limiting plate 29, the first cleaning sponge 23 and the second cleaning sponge 24 clamp the bowl or the plate.

A rotary drive mechanism 3, arranged below the dish cleaning mechanism 2 and used for driving the dish to do a unidirectional rotation. The rotary drive mechanism 3 includes two transmission rollers 31 arranged in parallel. One of the transmission rollers 31 is connected with an output end of a second drive motor 32 through a coupling. The other ends of the two transmission rollers 31 are provided with synchronous gears 33, and a transmission belt 34 is connected between the two synchronous gears 33. After putting the bowl or the plate into the first cleaning sponge 23 and the second cleaning sponge 24, a lower part of the bowl or the plate falls onto the two transmission rollers 31. The two transmission rollers 31 may drive the bowl or the plate to rotate in a forward direction and a reverse direction alternately under an effect of the transmission belt 34. A time interval of the alternate rotation may be set as 30 seconds. In a rotation process, the first cleaning sponge 23 and the second cleaning sponge 24 realize contact cleaning of the surface of the bowl or the plate.

A liquid supply mechanism 4, arranged in the casing 1 and used for providing a detergent or tap water for cleaning of two sides of the dish in a spraying manner. The liquid supply mechanism 4 includes a liquid supply pump 41. A liquid inlet pipe 42 of the liquid supply pump 41 is connected with a washing liquid tank 43 and a tap water pipe 44 respectively. A liquid outlet pipe 45 of the liquid supply pump 41 is connected with a plurality of nozzles 46. After the dish cleaning mechanism 2 clamps the dish, the nozzles 46 are distributed on the two sides of the dish. When the dish is rotated, the nozzles 46 first spray the dish with a detergent solution, and then spray tap water for cleaning.

A control system 6, configured to control and connect the dish cleaning mechanism 2, the rotary drive mechanism 3, and the liquid supply mechanism 4 for a clamping drive, a rotary drive, and a liquid supply cleaning drive during dish cleaning. The control system 6 includes a control unit 61, a material sensor 62 and a first position sensor 63 which are connected with the control unit 61. The control unit 61 is a PLC controller. The material sensor 62 is fixedly arranged in the first cleaning sponge 23, and is used for sensing whether the dish is put into the dishwasher. A position of the material sensor 62 corresponding to the first cleaning sponge 23 is provided with a through hole for sensing the dish. Automatic operation is started after detecting that the dish is put into the dishwasher, and a clamping force of the first cleaning sponge 23 and the second cleaning sponge 24 to the dish is calculated by a processor. Two sensing terminals of the first position sensor 63 are respectively arranged between the cleaning arm 22 and the fixed frame 21, and are used for sensing a displacement magnitude of a movement of the cleaning arm 22.

According to the sequential dishwasher and an automatic cleaning method of the present disclosure, when a small number of dishes are cleaned, on the one hand, there is no need to heat a water body, it is more energy-saving, there is no need to manually wash the dishes with heavy stains, and it is more convenient and economical to use; On the other hand, detergent consumption and water consumption of cleaning may be effectively saved while realizing rapid cleaning of the single dish, and the automatic cleaning of the dish is completed more efficiently.

Specifically, during use, the single dish is put into the dishwasher, the first cleaning sponge 23 and the second cleaning sponge 24 of the dish washing mechanism 2 clamp the dish, so that the first cleaning sponge 23 and the second cleaning sponge 24 are pressed on a side edge of the bowl in a vertical direction, the dish is rotated by the rotary drive mechanism 3, and the liquid supply mechanism 4 performs precise liquid supply cleaning on the dish. At this time, the first cleaning sponge 23 and the second cleaning sponge 24 rub against the dish to clean up stains, and the nozzles 46 rinses the stains down.

Embodiment 2

Referring to FIG. 9-FIG. 12, as another preferred embodiment of the present disclosure, a difference from Embodiment 1 is that a lifting mechanism 5 for lifting and lowering a dish washing mechanism 2 is further included. The lifting mechanism 5 is arranged on two sides of the dish cleaning mechanism 2 and includes a support wall 51. The support wall 51 is fixed on two sides of a casing 1. A sliding rail 52 is vertically fixed on the support wall 51. A movable platform 53 is slidably connected to the sliding rail 52. A second screw rod 54 for driving the moving platform 53 to move up and down is fixed on the support wall 51. One end of the second screw rod 54 is provided with a third drive motor 55 for driving the second screw rod to rotate. The dish cleaning mechanism 2 may be lifted to an outside of the casing 1 through the lifting mechanism 5, so that the dish may be conveniently picked up and placed. In order to better control lifting and lowering of the dish cleaning mechanism 2, the control system 6 further includes a plurality of second position sensors 64 connected with a control unit 61, and two sensing terminals of each of the plurality of second position sensors 64 are respectively arranged between the movable platform 53 and the support wall 51, and are used for sensing the lifting height of the lifting mechanism 5.

Embodiment 3

Figure 12:
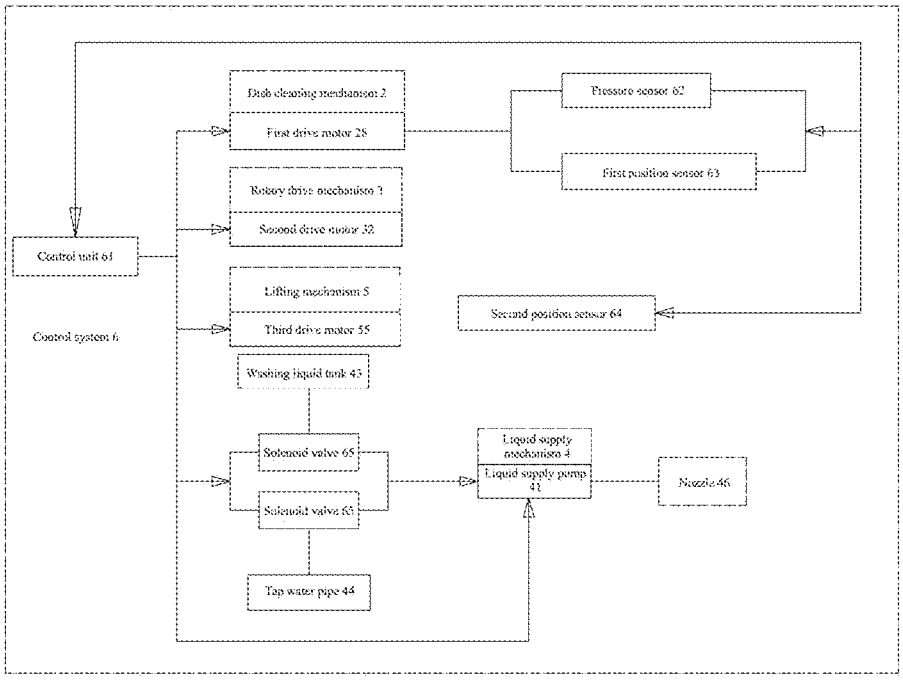
FIG. 12 is a system block diagram of a control system in the present disclosure.

Referring to FIG. 12, as another preferred embodiment of the present disclosure, a difference from Embodiment 1 is that the control system 6 further includes two solenoid valves connected with the control unit 61, and the two solenoid valves 65 are respectively arranged on a liquid inlet pipe 42 connected with the washing liquid tank 43 and the tap water pipe 44. The supply of a detergent and tap water is realized by controlling the solenoid valves 65 and using a same liquid supply pump 41. When a detergent solution is supplied, the solenoid valve on the washing liquid tank 43 is opened, and the solenoid valve on the tap water pipe 44 is closed. When tap water is supplied, the solenoid valve on the washing liquid tank 43 is closed, and the solenoid valve on the tap water pipe 44 is opened. Opening and closing the two solenoid valves 65 and durations of opening and closing are all controlled by the control unit 61.

Embodiment 4

For further explanation, the present disclosure provides an automatic cleaning method for dishes, used for a sequential dishwasher, specifically including the following steps.

Step 1, the sequential dishwasher is started, a bowl or a plate to be cleaned is put on a dish cleaning mechanism 2, and the bowl or the plate is clamped by the dish cleaning mechanism 2.

Step 2, a rotary drive mechanism 3 is started to drive the bowl or the plate to perform a forward or reverse unidirectional rotation.

Step 3, a liquid supply mechanism 4 is started to spray a quantitative detergent to two sides of the bowl or the plate, after completing cleaning time of the detergent for the bowl or the plate, tap water is continuously sprayed to two sides of the bowl or the plate until cleaning time of the tap water for the bowl or the plate is completed, and the liquid supply mechanism 4 is turned off.

Step 4, after completing step 3, the rotary drive mechanism 3 is turned off, the dish cleaning mechanism 2 is reset, and cleaning of the bowl or the plate is completed.

The above are only preferred embodiments of the present disclosure and are not used for limiting the present disclosure, although the present disclosure is described in detail with reference to the foregoing embodiments, for those of skill in the art, it is still possible to modify the technical solutions described in the foregoing embodiments, or to equivalently replace some of the technical features therein. Any modification, equivalent replacement, improvement, etc. made within the spirit and principle of the present disclosure should be included in the scope of protection of the present disclosure.

What is claimed is:

1. A sequential dishwasher, comprising a casing (1) to the bottom of which a drainage pipe (11) is connected, characterized in that further comprising:

a dish cleaning mechanism (2), arranged in the casing (1) and used for clamping and cleaning a single dish;

a rotary drive mechanism (3), arranged below the dish cleaning mechanism (2) and used for driving the dish to rotate in forward and reverse directions alternately;

a liquid supply mechanism (4), arranged in the casing (1) and used for providing a detergent or tap water for cleaning of two sides of the dish in a spraying manner; and a control system (6), configured to control and connect the dish cleaning mechanism (2), the rotary drive mechanism (3), and the liquid supply mechanism (4) for a clamping drive, a rotary drive, and a liquid supply cleaning drive during dish cleaning, wherein the dish cleaning mechanism (2) comprises a fixed frame (21), a cleaning arm (22), a first cleaning sponge (23), and a second cleaning sponge (24), wherein the first cleaning sponge (23) and the second cleaning sponge (24) are respectively correspondingly arranged on the fixed frame (21) and the cleaning arm (22), the first cleaning sponge (23) is fixed on the fixed frame (21) in a vertical state, the second cleaning sponge (24) is fixed on the cleaning arm (22) in an L-shaped state, and a linear drive mechanism for driving the second cleaning sponge (24) to move in parallel is arranged below the cleaning arm (22).

2. The sequential dishwasher according to claim 1, characterized in that the linear drive mechanism comprises a first drive motor (28), a first screw rod (27), guide shafts (26), and a sliding block (25), two sides of the sliding block (25) are slidably connected on the guide shafts (26), one end of the cleaning arm (22) away from the second cleaning sponge (24) is fixed on the sliding block (25), the first screw rod (27) for driving the movement of the sliding block (25) is arranged between the two guide shafts (26), one end of the first screw rod (27) is provided with the first drive motor (28) for driving the first screw rod to rotate, and one side of the sliding block (25) corresponding to the second cleaning sponge (24) is provided with a dish limiting plate (29).

3. The sequential dishwasher according to claim 2, characterized in that the control system (6) comprises a control unit (61), a material sensor (62) and a first position sensor (63) which are connected with the control unit (61), the material sensor (62) is fixedly arranged in the first cleaning sponge (23), is used for sensing whether the dish is put into the dishwasher, and starts automatic operation after detecting that the dish is put into the dishwasher, and two sensing terminals of the first position sensor (63) are respectively arranged between the cleaning arm (22) and the fixed frame (21), and are used for sensing a displacement magnitude of a movement of the cleaning arm (22).

4. The sequential dishwasher according to claim 1, characterized in that the rotary drive mechanism (3) comprises two transmission rollers (31) arranged in parallel, one of the transmission rollers (31) is connected with an output end of a second drive motor (32) through a coupling, the other ends of the two transmission rollers (31) are provided with synchronous gears (33), and a transmission belt (34) is connected between the two synchronous gears (33).

5. The sequential dishwasher according to claim 1, characterized in that further comprising a lifting mechanism (5) for lifting and lowering the dish cleaning mechanism (2), wherein the lifting mechanism (5) is arranged on two sides of the dish cleaning mechanism (2) and comprises a support wall (51), the support wall (51) is fixed on two sides of the casing (1), a sliding rail (52) is vertically fixed on the support wall (51), a movable platform (53) is slidably connected to the sliding rail (52), a second screw rod (54) for driving the moving platform (53) to move up and down is fixed on the support wall (51), and one end of the second screw rod (54) is provided with a third drive motor (55) for driving the second screw rod to rotate.

6. The sequential dishwasher according to claim 5, characterized in that the control system (6) further comprises a plurality of second position sensors (64) connected with a control unit (61), and two sensing terminals of each of the plurality of second position sensors (64) are respectively arranged between the movable platform (53) and the support wall (51), and are used for sensing the lifting height of the lifting mechanism (5).

7. The sequential dishwasher according to claim 1, characterized in that the liquid supply mechanism (4) comprises a liquid supply pump (41), a liquid inlet pipe (42) of the liquid supply pump (41) is connected with a washing liquid tank (43) and a tap water pipe (44) respectively, a liquid outlet pipe (45) of the liquid supply pump (41) is connected with a plurality of nozzles (46), and after the dish cleaning mechanism (2) clamps the dish, the nozzles (46) are distributed on two sides of the dish.

8. The sequential dishwasher according to claim 7, characterized in that the control system (6) further comprises two solenoid valves (65) connected with a control unit (61), and the two solenoid valves (65) are respectively arranged on the liquid inlet pipe (42) connected with the washing liquid tank (43) and the tap water pipe (44).

9. An automatic cleaning method for dishes, used for the sequential dishwasher according to claim 1, the method comprising utilizing the control system to:

cause the dish cleaning mechanism (2) to clamp a single dish placed thereon;

cause the rotary drive mechanism (3) to alternately rotate the clamped dish in forward and reverse directions;

cause the liquid supply mechanism (4) to perform a spraying sequence that comprises:

(i) spraying a measured quantity of detergent onto two sides of the dish, and (ii) subsequently spraying tap water onto the two sides of the dish;

cause the liquid supply mechanism (4) to stop spraying;

cause the rotary drive mechanism (3) to stop rotating; and cause the dish cleaning mechanism (2) to reset.

* * * * *